US009462902B1

(12) United States Patent
Rukel

(10) Patent No.: US 9,462,902 B1
(45) Date of Patent: Oct. 11, 2016

(54) HEALTH PILLOW

(71) Applicant: John Rukel, St. Charles, IL (US)

(72) Inventor: John Rukel, St. Charles, IL (US)

( * ) Notice: Subject to any disclaimer, the term of this patent is extended or adjusted under 35 U.S.C. 154(b) by 0 days.

(21) Appl. No.: 14/755,512

(22) Filed: Jun. 30, 2015

Related U.S. Application Data

(60) Provisional application No. 62/085,667, filed on Dec. 1, 2014, provisional application No. 62/018,714, filed on Jun. 30, 2014.

(51) Int. Cl.
*A47C 20/00* (2006.01)
*A47G 9/10* (2006.01)
*A47G 9/00* (2006.01)

(52) U.S. Cl.
CPC ..... *A47G 9/10* (2013.01); *A47G 9/007* (2013.01); *A47G 2009/1018* (2013.01)

(58) Field of Classification Search
CPC . A47G 9/10; A47G 9/007; A47G 2009/1018
See application file for complete search history.

(56) References Cited

U.S. PATENT DOCUMENTS 3,148,389 A * 9/1964 Lustig ..... A47C 27/144 5/643
4,277,859 A * 7/1981 Seaman ..... A45C 9/00 383/25
4,618,531 A * 10/1986 Marcus ..... D04H 1/42 264/117
4,768,248 A * 9/1988 O'Sullivan ..... A47G 9/10 5/640
4,794,038 A * 12/1988 Marcus ..... A47G 9/00 264/117
4,820,574 A * 4/1989 Tesch ..... A47G 9/00 428/100
4,959,880 A * 10/1990 Tesch ..... A47G 9/10 5/490
5,218,740 A * 6/1993 Snyder ..... D04H 1/005 19/66 R
5,238,612 A * 8/1993 Halm ..... A47G 9/00 264/117
5,286,556 A * 2/1994 Tesch ..... B68G 1/00 428/369
5,338,500 A * 8/1994 Halm ..... A47G 9/00 264/115
5,344,707 A * 9/1994 Snyder ..... A47G 9/00 428/359
5,480,710 A * 1/1996 Frankosky ..... D04H 1/005 428/359
5,500,295 A * 3/1996 Halm ..... A47G 9/00 428/357
5,566,410 A * 10/1996 Schaechter ..... A47G 9/0253 5/490

(Continued)

*Primary Examiner* — David E Sosnowski
(74) *Attorney, Agent, or Firm* — Vedder Price P.C.

(57) ABSTRACT

A system and method for providing a user-customizable health pillow allowing a user to configure characteristics of the pillow to meet user needs and/or desires, or alternatively, to preconfigure during manufacture of the health pillow that inhibits misconfiguration of the pillow. The health pillow includes a special filling having fiber balls and high resiliency foam contained within an inner felt liner and an outer breathable fabric. A special access sleeve permits customization of the fill level for user needs/desires when the pillow includes a closure system permitting end user configuration of the filling type and/or quantity.

13 Claims, 7 Drawing Sheets

(56) References Cited

U.S. PATENT DOCUMENTS 5,659,911 A * 8/1997 Kirkbride ..... A47G 9/10 428/401
5,683,811 A * 11/1997 Hernandez ..... D01D 5/24 428/221
6,141,807 A * 11/2000 Tapper ..... A47C 3/16 5/640
6,594,838 B1 * 7/2003 Hollander ..... A47G 9/10 5/490
7,089,617 B1 * 8/2006 Lauro ..... A47G 9/10 5/490
7,415,742 B2 * 8/2008 Wassilefsky ..... A47G 9/10 5/490
7,461,424 B2 * 12/2008 Lindell ..... A47G 9/10 428/304.4
8,127,382 B1 * 3/2012 Plascencia ..... A47G 9/0238 5/490
8,646,134 B1 * 2/2014 Alletto, Jr. ..... A47G 9/1036 5/490
8,656,537 B2 * 2/2014 Leifermann ..... A47G 9/0253 5/636
8,959,683 B2 * 2/2015 Rochlin ..... A47G 9/10 5/490
9,247,836 B2 * 2/2016 DuPre ..... A47G 9/0253
2004/0019972 A1 * 2/2004 Schecter ..... A47G 9/10 5/645
2005/0166378 A1 * 8/2005 Matthews Brown .... A47G 9/10 29/91.1
2005/0210591 A1 * 9/2005 Mead ..... A47D 13/08 5/639
2006/0010603 A1 * 1/2006 Ellison ..... A47G 9/10 5/636
2006/0123547 A1 * 6/2006 Ferber ..... A47G 9/10 5/636
2007/0271703 A1 * 11/2007 Matthews Brown .. A47D 13/08 5/636
2008/0235877 A1 * 10/2008 Murray ..... A47G 9/10 5/640
2009/0007339 A1 * 1/2009 Chen ..... A47C 7/021 5/655.9
2009/0126117 A1 * 5/2009 Lazarus ..... A47G 9/10 5/644
2011/0185500 A1 * 8/2011 Sanders ..... A47C 27/007 5/502
2012/0030876 A1 * 2/2012 Schwingendorf .... A47G 9/1054 5/640
2012/0204350 A1 * 8/2012 Katsnelson ..... A47G 9/1027 5/644
2013/0111661 A1 * 5/2013 Furuland ..... A47D 7/01 5/93.1
2013/0263377 A1 * 10/2013 Wootten, Jr. ..... A47C 23/00 5/640
2014/0223664 A1 * 8/2014 Kanbar ..... A47G 9/10 5/636
2015/0044393 A1 * 2/2015 Uretsky ..... B68G 1/00 428/6

* cited by examiner

HEALTH PILLOW

CROSS REFERENCE TO RELATED APPLICATIONS

The application claims benefit of U.S. Patent Application No. 62/018,714 filed 30 Jun. 2014 and also claims benefit of U.S. Patent Application No. 62/085,667 filed 1 Dec. 2014, the contents of which are hereby expressly incorporated by reference in their entireties for al. purposes.

FIELD OF THE INVENTION

The present invention relates generally to a cushioned support for a person, and more specifically, but not exclusively, to a pillow such as a sleeping pillow or therapy pillow.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

During supine, prone, semi-supine, semi-prone, and other lying or reclining positions for rest, medical treatment, or sleep, a user often uses one or more pillows. Commonly a pillow is positioned under a head and/or a neck of the user. There are various conditions occurring during rest, treatment, and/or sleep that can interfere with the "activity" when using the pillow.

These conditions may include sweating during sleep, inadequate head/neck support, breathing interruptions (e.g., apnea). Each user may have one or more of these conditions, sometimes concurrently and sometimes at different times, and a single universal pillow design may not always meet a user's needs or desires with respect to that condition or set of conditions.

What is needed is a system and method for providing a user-customizable health pillow allowing a user to configure characteristics of the pillow to meet user needs and/or desires.

BRIEF SUMMARY OF THE INVENTION

A system and method for providing a user-customizable health pillow allowing a user to configure characteristics of the pillow to meet user needs and/or desires. The health pillow includes a special filling having fiber balls and high resiliency foam contained within an inner felt liner and an outer breathable fabric. A special access sleeve permits customization of the fill level for user needs/desires.

The following summary of the invention is provided to facilitate an understanding of some of technical features related to manufacture and use of a health pillow, and is not intended to be a full description of the present invention. A full appreciation of the various aspects of the invention can be gained by taking the entire specification, claims, drawings, and abstract as a whole. The present invention is applicable to other cushioning systems, particularly for systems for aiding rest and/or treatment of a person.

Benefits of this pillow include that it is antimicrobial, hypo-allergenic mildew resistant, and 100% machine washable and dryable (with significantly reduced mold and fungal growth potential). Comfort and support benefits of this pillow are provided by a unique combination of materials and include a side zipper sleeve that allows a user to remove or add as much filling as needed to create a completely customized fit. A set of cooling benefits of the pillow come from the extremely breathable and stretchy moisture wicking fabric of the outer layer.

Embodiments of the present may include one or more inventive aspects, including an adjustable firmness (e.g., customized filling quantity using a novel zippered sleeve), a multi-component medical-grade fill including a mixture of siliconized polyester cluster fiber balls and high resilience shredded foam that may be made without ozone depleters, PBDE flame retardants, mercury/lead/heavy metals, formaldehyde and prohibited phthalates, along with low volatile organic compounds, and a multi-component moisture wicking breathable cover, and combinations thereof.

Some embodiments may include a zipperless implementation, such as when filling type and quantity is determined at time of manufacture. End-user features for adapting the filling type and quantity may be constrained, such as by removal of the zipper and inner protective sleeve while preserving other features as described herein.

A pillow, including an inner liner including a pair of opposing sidewalls coupled together defining an inner cavity; and a filling disposed within the interior cavity, the filling including a mixture of a plurality of cluster fiber balls and a quantity of shredded foam, a ratio of the cluster fiber balls to the quantity of shredded foam in a range of 60/40 to 40/60, by weight.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Figure 1:
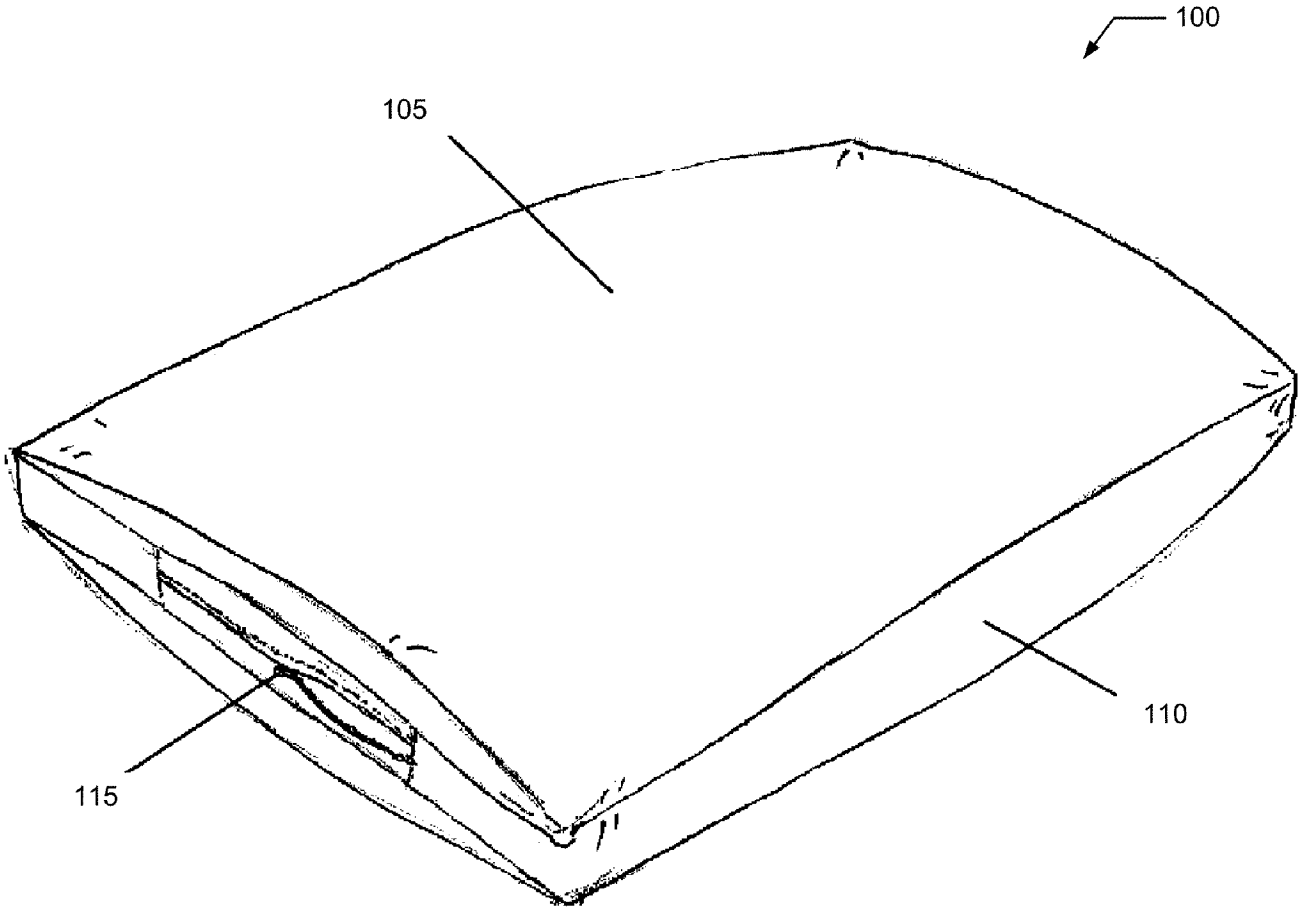
FIG. 1 illustrates a perspective view of a health pillow.

Embodiments of the present invention provide a system and method for providing a user-customizable health pillow allowing a user to configure characteristics of the pillow to meet user needs and/or desires. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Definitions

The following definitions apply to some of the aspects described with respect to some embodiments of the invention. These definitions may likewise be expanded upon herein.

As used herein, the term "or" is generally intended to mean "and/or" unless otherwise indicated.

As used herein, the singular terms "a," "an," and "the" include plural referents unless the context clearly dictates otherwise. Thus, for example, reference to an object can include multiple objects unless the context clearly dictates otherwise.

Also, as used in the description herein and throughout the claims that follow, the meaning of "in" includes "in" and "on" unless the context clearly dictates otherwise.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "connect," "connected," and "connecting" refer to a direct attachment or link. Connected objects have no or no substantial intermediary object or set of objects, as the context indicates.

As used herein, the terms "couple," "coupled," and "coupling" refer to an operational connection or linking. Coupled objects can be directly connected to one another or can be indirectly connected to one another, such as via an intermediary set of objects.

As used herein, the terms "substantially" and "substantial" refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

As used herein, the terms "optional" and "optionally" mean that the subsequently described event or circumstance may or may not occur and that the description includes instances where the event or circumstance occurs and instances in which it does not.

As used herein, the term "size" refers to a characteristic dimension of an object. Thus, for example, a size of an object that is spherical can refer to a diameter of the object. In the case of an object that is non-spherical, a size of the non-spherical object can refer to a diameter of a corresponding spherical object, where the corresponding spherical object exhibits or has a particular set of derivable or measurable properties that are substantially the same as those of the non-spherical object. Thus, for example, a size of a non-spherical object can refer to a diameter of a corresponding spherical object that exhibits light scattering or other properties that are substantially the same as those of the non-spherical object. Alternatively, or in conjunction, a size of a non-spherical object can refer to an average of various orthogonal dimensions of the object. Thus, for example, a size of an object that is a spheroidal can refer to an average of a major axis and a minor axis of the object. When referring to a set of objects as having a particular size, it is contemplated that the objects can have a distribution of sizes around the particular size. Thus, as used herein, a size of a set of objects can refer to a typical size of a distribution of sizes, such as an average size, a median size, or a peak size.

Figure 2:
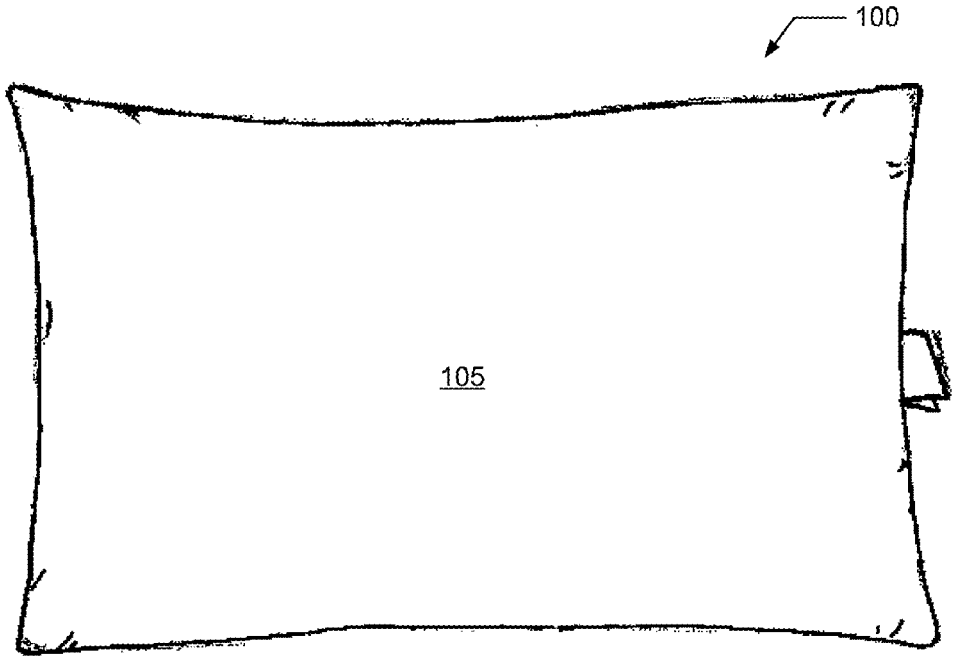
FIG. 2 illustrates a top plan view of the health pillow of FIG. 1.
Figure 3:
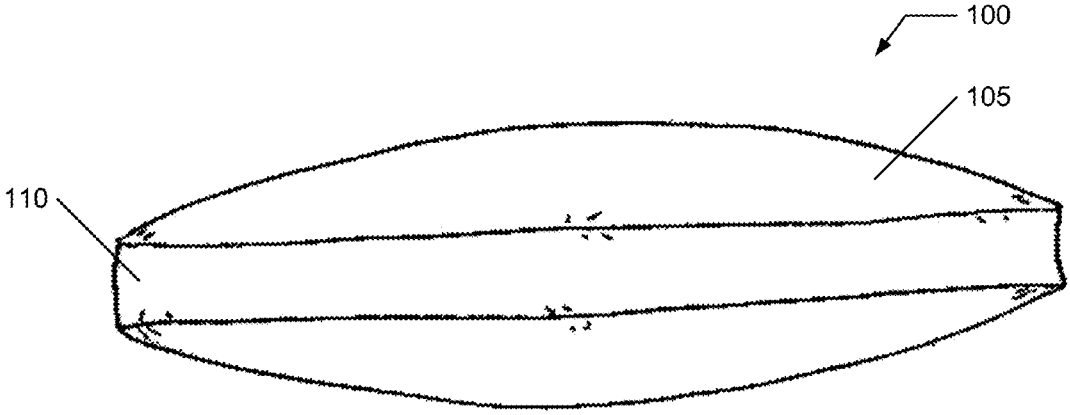
FIG. 3 illustrates a front elevation view of the health pillow of FIG. 1.
Figure 4:
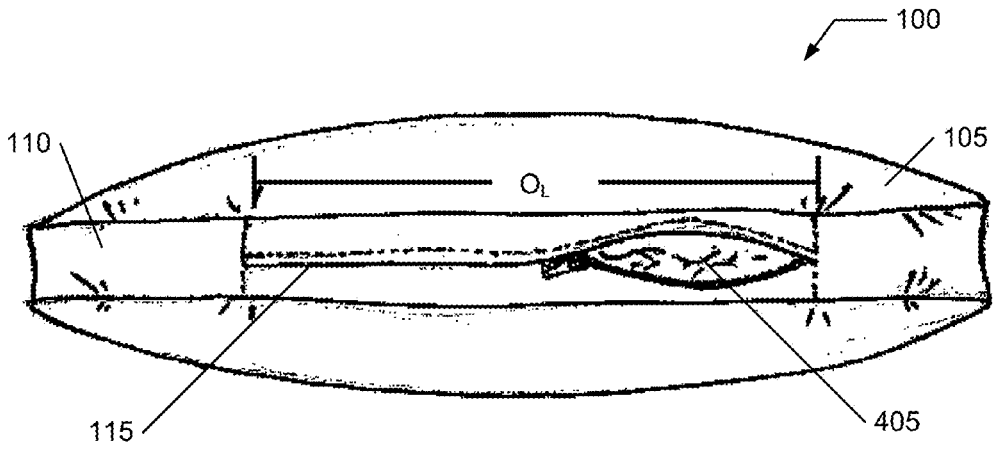
FIG. 4 illustrates a side elevation view of the health pillow of FIG. 1.

FIG. 1 illustrates a perspective view of a health pillow 100; FIG. 2 illustrates a top plan view of health pillow 100; FIG. 3 illustrates a front elevation view of health pillow 100; and FIG. 4 illustrates a side elevation view of health pillow 100. Pillow 100 includes an outer covering 105 and a set of side gussets 110 disposed between opposing sides (e.g., a top side and a bottom side) of pillow 100. One side gusset 110 includes a side opening 115.

Covering 105 includes a moisture wicking configuration. For example, covering 105 is made from a light weight stretchy polyester fabric that features strategically placed ventilation zones allowing air to flow and cool the body where needed. This extremely breathable fabric has an air flow rating of approximately 140-180, for example, 160 CFM (cubic feet/minute). This durable four-way stretch material is specifically designed to wick heat and moisture away from skin of the user to help the user stay cool and dry. The fabric aids in moisture management by moving perspiration from the skin to the opposite side of the fabric for rapid evaporation. As moisture is produced by the body, it moves through the hydrophobic layer of fabric, which acts as a pump to move the moisture away from the skin to keep the user cool. This moisture wicking technology is sometimes also found in clothes worn by athletes who sweat for long periods of time and want to stay drier, such as long-distance running, tennis, and golf. This superior breathability provides a cooler and more comfortable temperature all night long, resulting in a better night's rest.

There are a variety of different specific configurations for outer layer 105. For example, one implementation includes a combination of polyester and Spandex in a range of 85/15-95/5, for example 90% polyester and 10% Spandex, having a material weight of 6-8, for example 7, ounces/square yard. A variety of colors (e.g., fluorescent white) may be used. Outer layer includes antimicrobial wicking characteristics.

A length and a width of the opposing sides of pillow 100 may be customized as desired. For example, a thirty inch length (Queen size) or a thirty-four inch length (King size), and a twenty inch width. Pillow 100 has a customizable height based upon an amount of fill included by the user, nominally pillow 100 includes a six inch height.

Gusset 110 includes a piece of fabric (e.g., a two inch wide strip) that is incorporated between the side seams of the top and bottom sides. Gusset 110 enables pillow 100 to provide a higher loft and thicker appearance which produces a luxurious style and added comfort. Gusset 110 provides superior head and neck support by encouraging head and neck alignment. Gusset 110 contributes to making pillow 100 more comfortable because a filling is able to maintain a higher loft allowing pillow 100 to maintain a generally consistent height extending edge-to-edge.

Gusset 110 may be constructed of the same material as outer covering 105 or an alternative material (for example, preferably, a polyester micro fiber having about 5.9 ounces/square yard (white) with antimicrobial and water repellent properties).

As further detailed below, pillow 100 preferably includes a special composite filling to help configure its special characteristics. Opening 115 allows the user to selectively and controllably vary the quantity of this filling to meet personal tastes.

As detailed in FIG. 4, side opening 115 includes a closure system (e.g., a zipper or the like) concealing an access sleeve 405. Side opening 115 may include an opening length ($O_L$) less than a width of pillow 100 (for example, a 10 inch $O_L$ for a twenty inch width). Opening the closure system permits access sleeve 405 to be extended from inside pillow 100. Access sleeve 405 is made from a material designed to contain and constrain the filling. For the filling described herein, access sleeve 405 is made of Spandex or the like.

Figure 5:
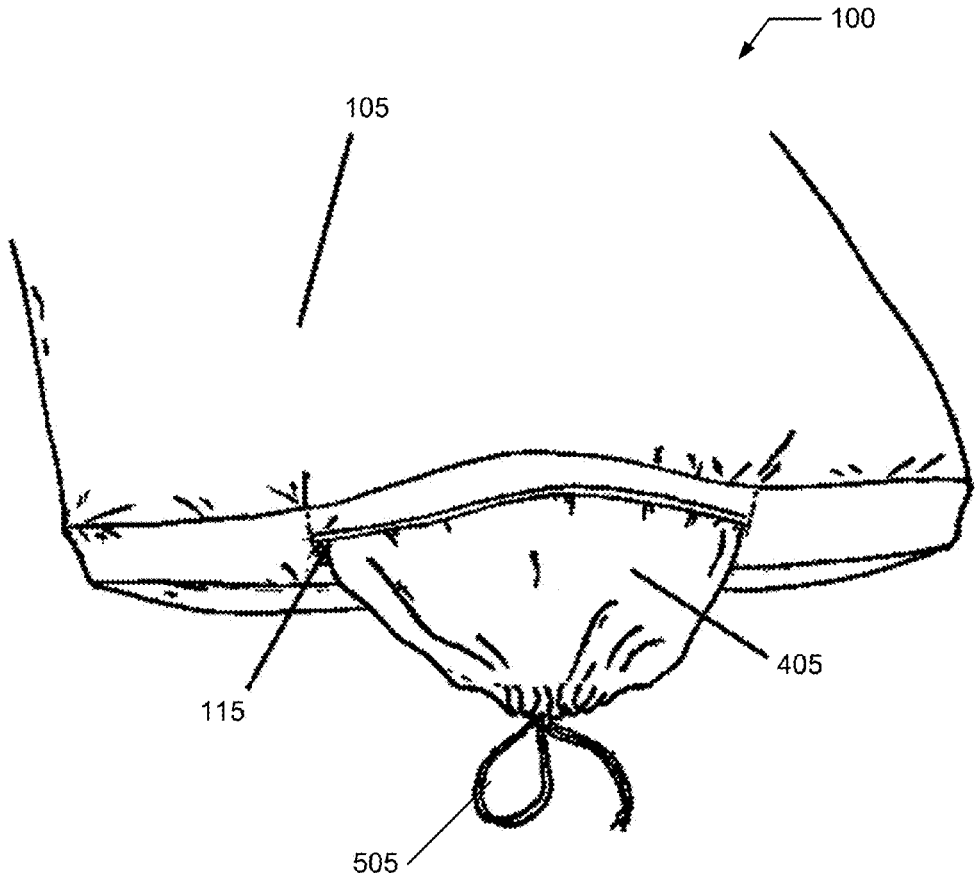
FIG. 5 illustrates a perspective view of a side section view of the health pillow of FIG. 1 revealing an inner funnel sleeve in a closed mode.
Figure 6:
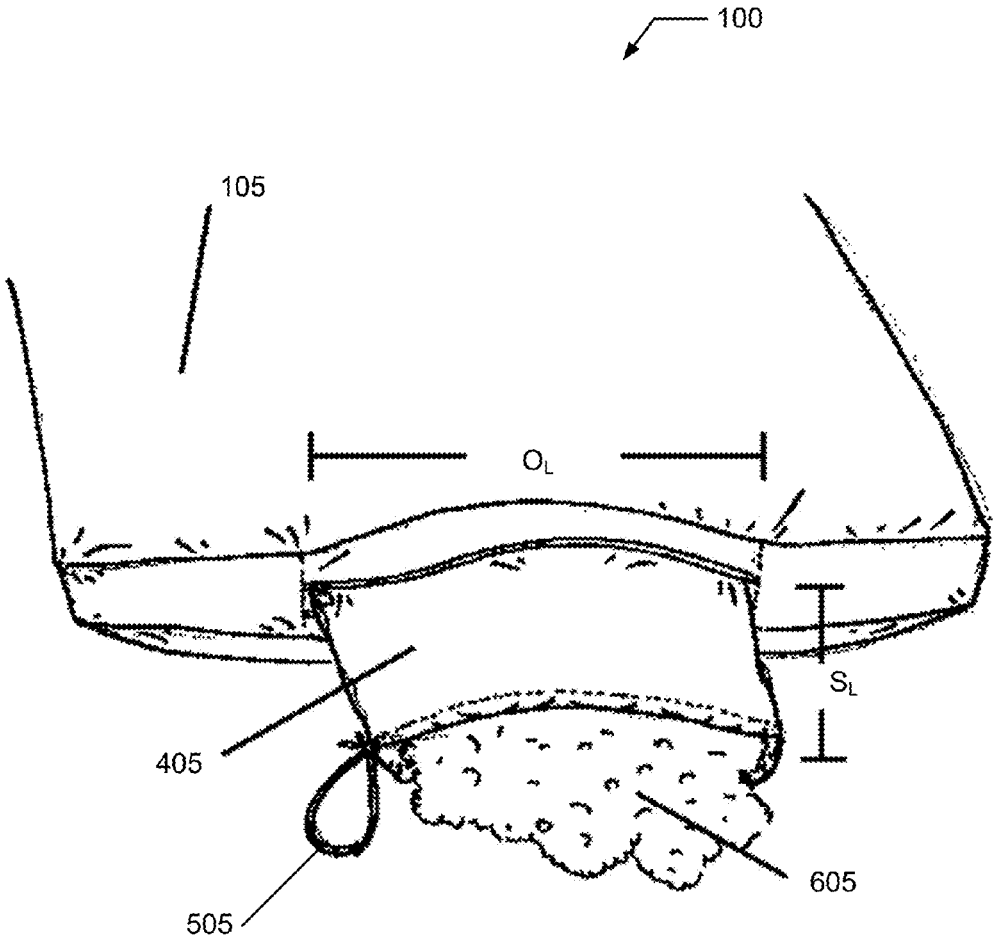
FIG. 6 illustrates a perspective view of the side section view of the health pillow of FIG. 5 presenting the inner funnel sleeve in an open mode.

FIG. 5 illustrates a perspective view of a side section view of health pillow 100 revealing access sleeve 405 in an extended and closed mode and FIG. 6 illustrates a perspective view of the side section view of the health pillow of FIG. 5 presenting access sleeve 405 in an open mode. Access sleeve 405 acts a closable "funnel" with a second closure system that opens and closes (for example using a thirty inch polyester drawstring 505) permitting access to the interior of pillow 100.

The filling of pillow 100 may be added or removed through access sleeve 405. As illustrated in FIG. 6, access sleeve 405 has a sleeve length ($S_L$) when extended outside pillow 100 (for example eight inches). When opened, access sleeve 405 permits a foam mixture 605 to be added or removed from pillow 100. Users can literally customize the fluff of their pillow exactly to their liking. Once the first closure is opened, the eight inch long sleeve with a thin drawstring may be extended and opened. One purpose of access sleeve 405 is to contain and prevent filling 605 from easily spilling out of pillow 100 when opening 115 is opened (a secondary containment system for filling 605). It is also used for added safety to make it difficult for small children to have access to filling 605.

Figure 7:
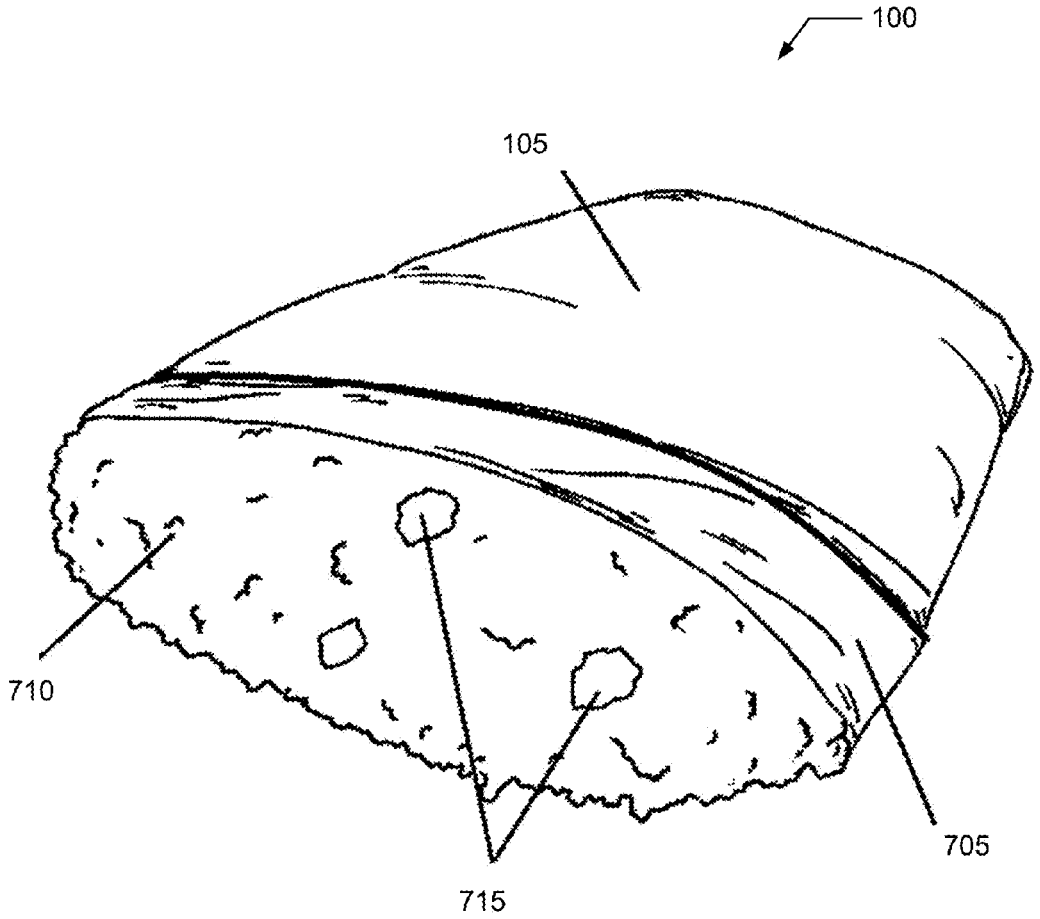
FIG. 7 illustrates a perspective view of a representation of a preferred implementation of a possible fill configuration used for the health pillow of FIG. 1.
Figure 8:
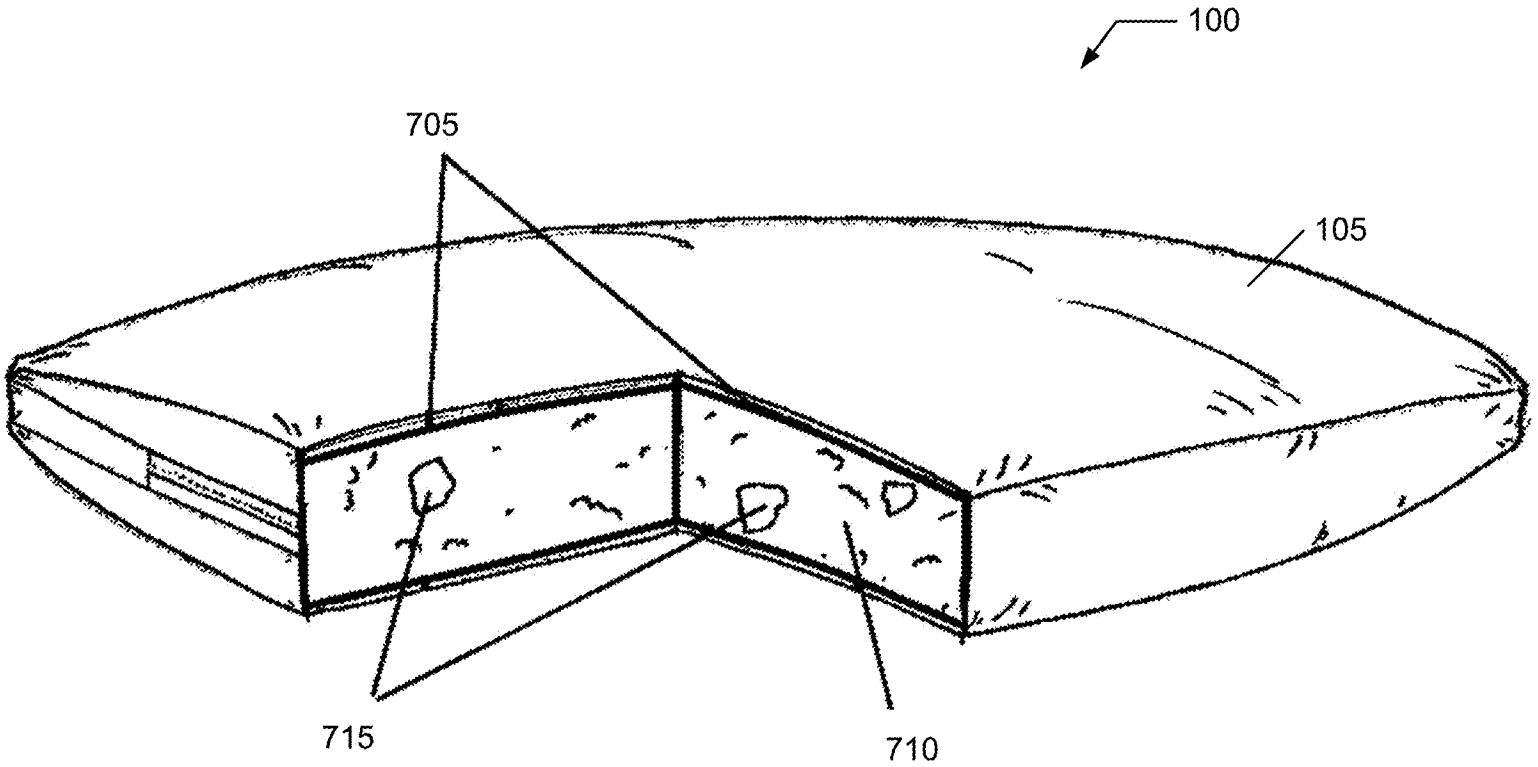
FIG. 8 illustrates a quarter-section view of the health pillow of FIG. 1.

FIG. 7 illustrates a perspective view of a representation of a preferred implementation of a possible fill configuration and internal arrangement used for health pillow 100; and FIG. 8 illustrates an internal view of health pillow 100.

As illustrated in FIG. 7, pillow 100 includes an inner liner 705 defining an inner cavity containing filling 605. Filling 605 includes a mixture of siliconized polyester cluster fiber balls 710 and high resilience shredded foam 715. This mixture includes a range for the fiber balls of sixty percent to forty percent (60%-40%) by weight of filling 605 and a corresponding range for the shredded foam of forty percent to sixty percent (40%-60%) by weight, for example fifty percent fiber balls and fifty percent shredded foam. As noted, a portion of filling 605 used in pillow 100 includes siliconized pearl shaped fiber balls that are constructed of more than 50 fibers per ball and preferably more than 100 single fibers per ball, each ball having an all-directional high elasticity that is incomparable to single fibers. Fiber balls 710 are relatively free moving inside pillow 100 and are subject to micro movements according to gestures and other movements of the user. Therefore the user will achieve automatic effects of a micro message as fiber balls 710 conform to the head during use (such as when resting or sleeping). These cluster fiber balls 710 offer more air-permeability than single fibers, for example because a space that exists between the balls is much larger. Even when compressed, the air permeability between the fiber fill balls of pillow 100 is much larger compared with that of traditional pillow filling fibers as fiber cluster balls help to maintain air flow that could be more significantly constricted in a configuration having shredded foam only. This effect helps keep an inside of pillow 100 dry and comfortable with less odor. These cluster fiber balls 710 are also configured to be machine washable. Any curled up tangled fiber balls 710 will expand during pressure due to the all-directional expanding elasticity. Therefore the elasticity will actually be rejuvenated after each wash. Filling 605 will also dry very fast due to the increased air permeability of fiber balls 710.

The other principal component of filling 600 used in pillow 100 includes high resilience shredded foam 715. Foam 715 has a cell structure that is very different than conventional foams. Each tiny cell structure is highly resilient and very strong which offers a much higher ability to bounce back after being compressed. This difference in cell structure leads to added support, comfort and durability. Foam 715 maintains its strength and memory for much longer than conventional foams. Foam 715 is antimicrobial, non-allergenic and toxic free. Due to its high density cell structure, it is naturally resistant to mildew, fungi, vermin and dust mites. Foam 715 is manufactured without chlorofluorocarbons or formaldehyde. Foam 715 is also known as inert foam, which means that very few chemical solvents will affect it at all. It can be washed, dry cleaned, steamed and sterilized. This foam also breathes quietly. Since 95% of its cells are open, air is squeezed in and out very easily. This foam is shredded into multiple sizes to perfectly conform to the head and neck for maximum comfort and support. The term shredding means, in the context of the present application, non-interlocking, irregular shaped, chipped foam ranging in size from ½" to 2" along any dimension. Non-interlocking is an important characteristic of the illustrated embodiments because it allows air to pass through more easily and contributes to an improved breathability/air permeability.

Components of filling 605 may be infused with unscented plant/botanical oil to add antimicrobial features to pillow 100. Some plant/botanical oils are naturally antimicrobial so adding this or other agent to pillow 100 along with any other antimicrobial agents or features further inhibits bacterial growth of pillow 100.

Liner 705 is of a type of material used in hospitals for skin care treatment. Liner 705 combined with outer covering 105 helps absorb moisture away from the skin and maintain a cool surface while allowing pillow 100 to perfectly confirm to a user's head and neck and provide improved comfort. Another important purpose of liner 705 is to act as a buffer and reduce any clumpy feel of larger chunks of shredded foam 715 against the skin.

Liner 705 may be implemented as a combination of polyester and rayon (e.g., 70/30 percent) having a material weight 3.3 ounces per square yard, of various colors (e.g., white) having antimicrobial properties. Balls 710 include siliconized 7 denier×32 millimeter hollow cluster fibers made from polyester (e.g., 100%). Foam 715 includes a high resiliency urethane foam having a density of 1.45 pounds and an ILD (indentation load deflection) of 15-19 and a resiliency (% rebound) of 40-48 (e.g., white) that is mixed with an antimicrobial agent.

Figure 9:
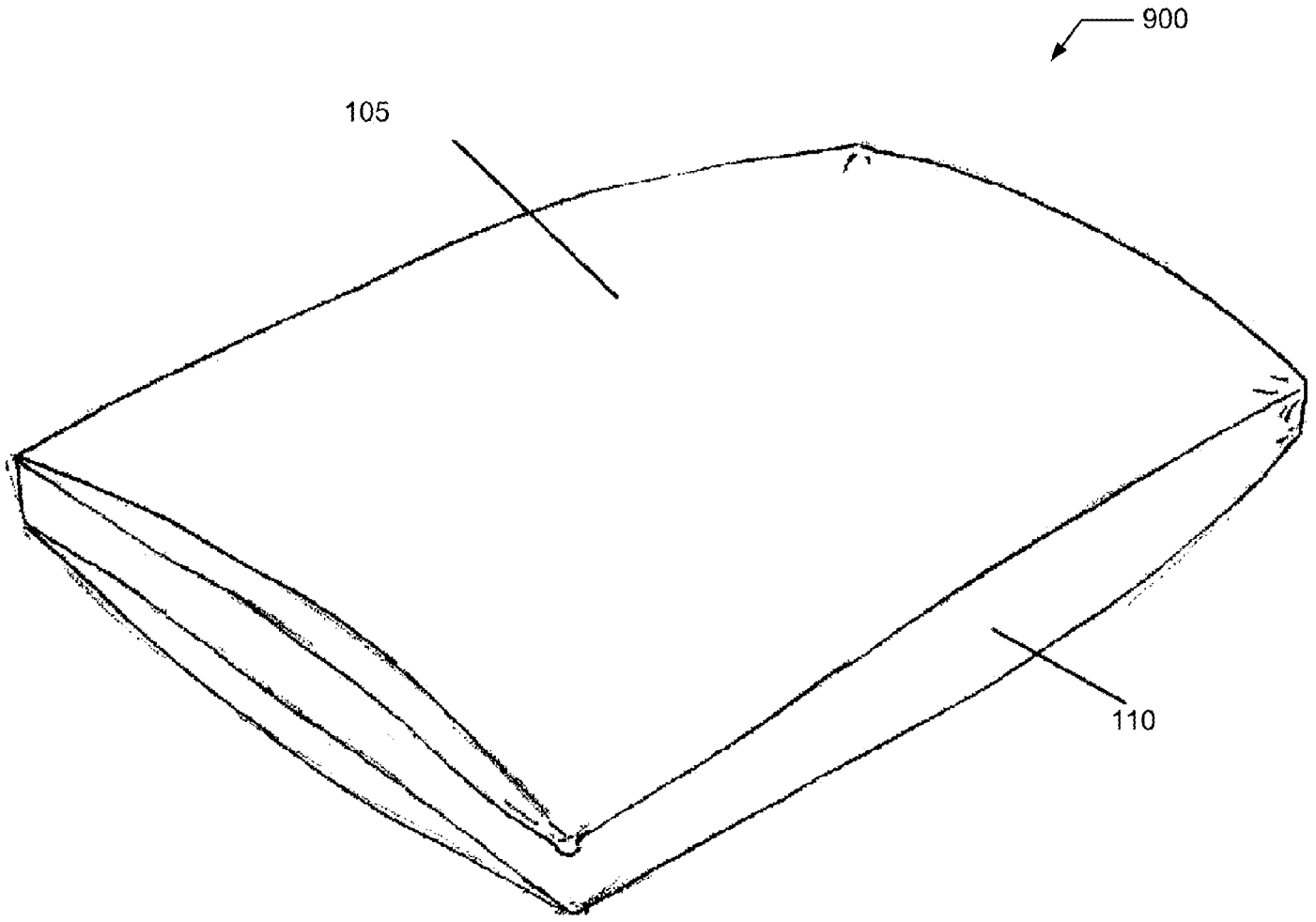
FIG. 9 illustrates a perspective view of an alternate health pillow.

FIG. 9 illustrates a perspective view of an alternate health pillow 900. Pillow 900 is similar to pillow 100 having outer covering 105 and a set of side gussets 110 disposed between opposing sides (e.g., a top side and a bottom side) of pillow 900. Pillow 900 is different from pillow 100 in that none of side gussets 110 include a side opening 115 (and hence, a user-operable closure system and may dispense with the protective sleeve). Without a closure system (e.g., zipper), an end user is not required to determine a particular filling type and quantity (and when prespecified and implemented during manufacturing, the end user is not able to adjust or alter fill type and quantity without degrading and/or damaging pillow 900.

Pillow 900 having a preconfigured and non-end user alterable fill type and quantity may advantageously be provided by a therapist who has defined or prescribed a particular fill type and quantity. The therapist may customize for any particular end user or may specify a set of pillows 900, each having a different predefined desired fill type and quantity to allow the therapist and/or end user to select the desired and/or optimum pillow 900 from the set. In other implementations, preconfiguration is also advantageous for marketing and sales to institutions like hotels, resorts and spas desiring the features and advantages of the present invention.

For certain treatments and conditions, it may be that a particular configuration of pillow 900 is advantageous for a particular end user while a different configuration or arrangement is advantageous for a different end user (or the same end user at a different treatment time). This allows the therapist and/or the end user to select (rather than manufacture) a particular pillow or set of pillows, or series of pillows for any particular treatment without requiring the end user to make any adjustments that may result in a misconfiguration inappropriate for the treatment and/or treatment plan.

The omission of the closure system (and any optional supporting materials) from pillow 900 not only inhibits misconfiguration by the end user, it also may result in a less expensive implementation which can promote wider adaptation and treatment.

The system and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Combinations of components or steps will also be considered as being noted, where terminology is foreseen as rendering the ability to separate or combine is unclear.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A pillow, comprising:

an outer covering;

an inner liner coupled to said outer covering, said inner liner including a pair of opposing sidewalls coupled together defining an inner cavity, wherein said inner liner defines an opening accessing said inner cavity, said inner lining including a closure system;

a resealable access sleeve directly coupled to a perimeter of said opening and coupled to said inner cavity, said resealable access sleeve configured to be stored within said inner cavity and selectively extended from said inner cavity, and a filling disposed within said resealable access sleeve, said filling including a mixture of a plurality of cluster fiber balls and a quantity of shredded foam, a ratio of said cluster fiber balls to said quantity of shredded foam in a range of 60/40 to 40/60, by weight;

wherein the inner liner is substantially contiguous with the outer covering.

2. The pillow of claim 1 wherein each said cluster fiber ball includes a pearl-shaped fiber ball having a minimum of 50 fibers.

3. The pillow of claim 2 wherein each said cluster fiber ball includes a siliconized 7 denier×32 millimeter hollow cluster fiber made from polyester.

4. The pillow of claim 3 wherein said quantity of shredded foam includes a resilient foam.

5. The pillow of claim 1 wherein said quantity of shredded foam includes a resilient foam.

6. The pillow of claim 5 wherein said resilient foam includes a resilient urethane foam having a density of 1.45 pounds and an ILD (indentation load deflection) of 15-19 and a resiliency (% rebound) of 40-48.

7. The pillow of claim 1 wherein a component of said filling includes an infusion of an unscented antimicrobial botanical oil.

8. The pillow of claim 4 wherein a component of said filling includes an infusion of an unscented antimicrobial botanical oil.

9. The pillow of claim 1 wherein said inner liner includes a combination of polyester and rayon having a material weight of 3.3 ounces per square yard.

10. The pillow of claim 1 wherein said covering includes a breathable, stretchable polyester fabric having a plurality of ventilation zones.

11. The pillow of claim 1 wherein said covering includes a combination of polyester and Spandex in a range of 85%/15%-95%/5% (a ratio of polyester to Spandex) having a material weight in a range of 6-8 ounces/square yard.

12. The pillow claim 1 wherein said covering includes an air flow rating of 140-180 CFM (cubic feet/minute).

13. A pillow, comprising:

an outer covering comprising a top surface separated from a bottom surface by one or more side gussets, wherein a first side gusset of said one or more side gussets has a first length defining an outer opening, the outer opening having a second length that is less than said first length;

an inner liner defining an inner cavity, wherein said inner liner further defines an opening accessing said inner cavity, said inner lining including a closure system, wherein said inner liner is coupled to and substantially contiguous with said outer covering;

an access sleeve coupled to the inner liner, the access sleeve defining an interior cavity and having at an end defining an inner opening, wherein the access sleeve is configured to selectively extend through the outer opening; and a filling disposed within said interior cavity of the access sleeve;

wherein the end of the access sleeve is configured to extend through the outer opening;

wherein the outer covering comprises a breathable, stretchable material formed from a combination of polyester and Spandex in a range of 85% polyester/15% Spandex-95%/o polyester/5% Spandex, the breathable, stretchable material having a material weight in a range of 6-8 ounces/square yard;

wherein the access sleeve comprises Spandex, the inner liner comprises a combination of polyester and rayon having a material weight of 3.3 ounces per square yard, and the outer covering comprises a combination of polyester and Spandex in a range of 85%/15%-95%/5% (a ratio of polyester to Spandex) having a material weight in a range of 6-8 ounces/square yard; and wherein the filling comprises a mixture of a plurality of cluster fiber balls, a quantity of shredded foam, and an unscented antimicrobial botanical oil with a ratio of said cluster fiber balls to said quantity of shredded foam in a range of 60/40 to 40/60, by weight.

* * * * *